US007055911B2

(12) United States Patent
Simpson et al.

(10) Patent No.: US 7,055,911 B2
(45) Date of Patent: Jun. 6, 2006

(54) MESH CHAIR

(75) Inventors: Stephen J. Simpson, Grand Rapids, MI (US); Brian Gessler, Hudsonville, MI (US); Matt Rutman, Jenison, MI (US)

(73) Assignee: Haworth, Inc., Holland, MI (US)

( * ) Notice: Subject to any disclaimer, the term of this patent is extended or adjusted under 35 U.S.C. 154(b) by 82 days.

(21) Appl. No.: 10/434,667

(22) Filed: May 8, 2003

(65) Prior Publication Data

US 2004/0222683 A1 Nov. 11, 2004

(51) Int. Cl.
*A47C 31/00* (2006.01)

(52) U.S. Cl. ..... 297/440.11; 297/452.56; 297/452.59

(58) Field of Classification Search ..... 297/440.11, 297/440.1, 452.13, 452.18, 452.1, 284.1, 297/463.2, 452.38, 452.56, 452.59
See application file for complete search history.

(56) References Cited

U.S. PATENT DOCUMENTS

| | | | | |
|---|---|---|---|---|
| 2,204,722 | A | 6/1940 | Bowles | |
| 2,251,318 | A | 8/1941 | Blair et al. | |
| 2,716,443 | A | 8/1955 | Laughlin | |
| 3,230,011 | A * | 1/1966 | Propst | 297/440.11 |
| 4,230,364 | A * | 10/1980 | Parker | 297/468 |
| 4,284,305 | A | 8/1981 | Porter et al. | |
| D267,757 | S | 2/1983 | Leib | |
| 4,431,229 | A | 2/1984 | Unger | |
| 5,207,478 | A | 5/1993 | Freese et al. | |
| 5,360,258 | A | 11/1994 | Alivizatos | |
| 5,393,126 | A * | 2/1995 | Boulva | 297/452.56 |
| 5,582,463 | A | 12/1996 | Linder et al. | |
| D423,259 | S | 4/2000 | Grove | |
| D423,260 | S | 4/2000 | Grove | |
| 6,050,646 | A | 4/2000 | Stenzel et al. | |
| 6,113,186 | A | 9/2000 | Holmes et al. | |
| 6,220,661 | B1 | 4/2001 | Peterson | |
| 6,231,125 | B1 | 5/2001 | Maeda et al. | |
| 6,254,190 | B1 * | 7/2001 | Gregory | 297/452.1 |
| 6,341,822 | B1 * | 1/2002 | Apissomian | 297/440.11 |
| 6,345,428 | B1 | 2/2002 | Apissomian | |
| 6,375,269 | B1 | 4/2002 | Maeda et al. | |
| 6,623,079 | B1 * | 9/2003 | Gregory | 297/440.11 |
| 6,698,839 | B1 * | 3/2004 | Ballendat | 297/440.11 |
| 2001/0030457 | A1 | 10/2001 | Gregory | |
| 2002/0003371 | A1 | 1/2002 | Link | |

* cited by examiner

*Primary Examiner*—Peter R. Brown
(74) *Attorney, Agent, or Firm*—Flynn, Thiel, Boutell & Tanis, P.C.

(57) ABSTRACT

A chair having a back assembly which includes a common back frame, multiple interchangeable crossbars, and a resiliently flexible cover. The cover includes an open interior or pocket which is adapted to receive the crossbar therein and prevent dislodgement of the crossbar. During assembly, the crossbar is first inserted within the open interior of the cover and then fitted into engagement with the back frame wherein the crossbar is held in place by stretching the cover and then engaging the lower edge of the cover with the back frame.

26 Claims, 15 Drawing Sheets

MESH CHAIR

FIELD OF THE INVENTION

The invention relates to an office chair, and more particularly, to an office chair having a back rest formed from a rigid frame and a flexible cover.

BACKGROUND OF THE INVENTION

It is known to provide an office chair having a back rest in which a flexible fabric cover is fitted onto a rigid frame to support the back of a user. The cover typically is formed of a mesh-like flexible material wherein the flexibility and resiliency of the fabric material serves to support and cushion the occupant's back. Separate padding or cushions are not provided and instead the chair back construction relies upon one or more exposed layers of the cover to resiliently support and cushion the occupant.

Office chairs with this type of back arrangement have relied upon various constructions for a back frame and cover material. It is an object of the invention to provide an improved frame and cover construction which overcomes disadvantages associated with prior chair constructions.

The invention relates to an office chair wherein the back construction comprises an internal multi-component frame and a fabric cover which covers the frame and supports the occupant's back in an open area of the frame.

More particularly, the back frame comprises laterally spaced apart rigid uprights which project upwardly from a seat assembly and define the contour and overall shape of the back. The frame includes a crossbar which defines a top edge of the back and has opposite ends which are removably engagable with the side rail. The crossbar is removable to permit fitting of a fabric cover on the side rails wherein the crossbar then is fitted into the cover into engagement with the side rails such that the fabric cover conforms to the crossbar and the side rails.

As to the fabric cover, the fabric cover includes a pocket at least at the upper edge thereof in which is received the crossbar. As such, the crossbar when engaged with the side rails is received within the pocket and pulled downwardly thereby. The cover further includes an attachment arrangement at the lower edge of the cover which is engagable with the back frame by first pulling the fabric cover tight and then engaging the cover to the chair. This tensions the fabric material such that the cover pulls downwardly on the crossbar and restrains the crossbar to prevent disengagement from the side rails.

The fabric cover may be formed as a sock that is hemmed on at least three sides and on a central portion of the bottom edge. The engagement structure in this arrangement comprises an attachment or retaining rod which inserts into the interior of the cover and nests within the lower hem wherein the opposite ends of the rod project outwardly of the sock and are engaged with the bottom of the back frame.

In a further embodiment, a single-layer cover or sock is provided which is hemmed about the periphery thereof to define tubular pockets along the sides and top edge and along a center section of the bottom edge. The pocket along the lower edge of the cover includes openings near the bottom corners to allow for an attachment or retaining rod to be fitted therethrough in the same manner as the multi-layer sock. To allow for fitting of the crossbar to the side rails, the upper edge of the hem also includes relatively small openings near the upper corners of the cover. First, one end of the crossbar is inserted into a corner opening, and then, the crossbar is slid entirely into the upper pocket. The opposite ends of the crossbar fit on the upper ends of the side rails such that the cover holds the crossbar in place. In this construction, it is preferable to provide an exterior trim assembly which clamps onto the upper edge of the cover and the crossbar to hide the crossbar and the corner openings.

With these arrangements, a fabric cover can be readily fitted onto the side rails of a back frame and a crossbar assembled in place. The crossbar thereby is held in place by the cover and the tensioning of the cover by the attachment rod. This provides for ready assembly and tensioning of the fabric material while improving upon the construction of the frame and simplifying the assembly process.

Other objects and purposes of the invention, and variations thereof, will be apparent upon reading the following specification and inspecting the accompanying drawings.

Figure 1:
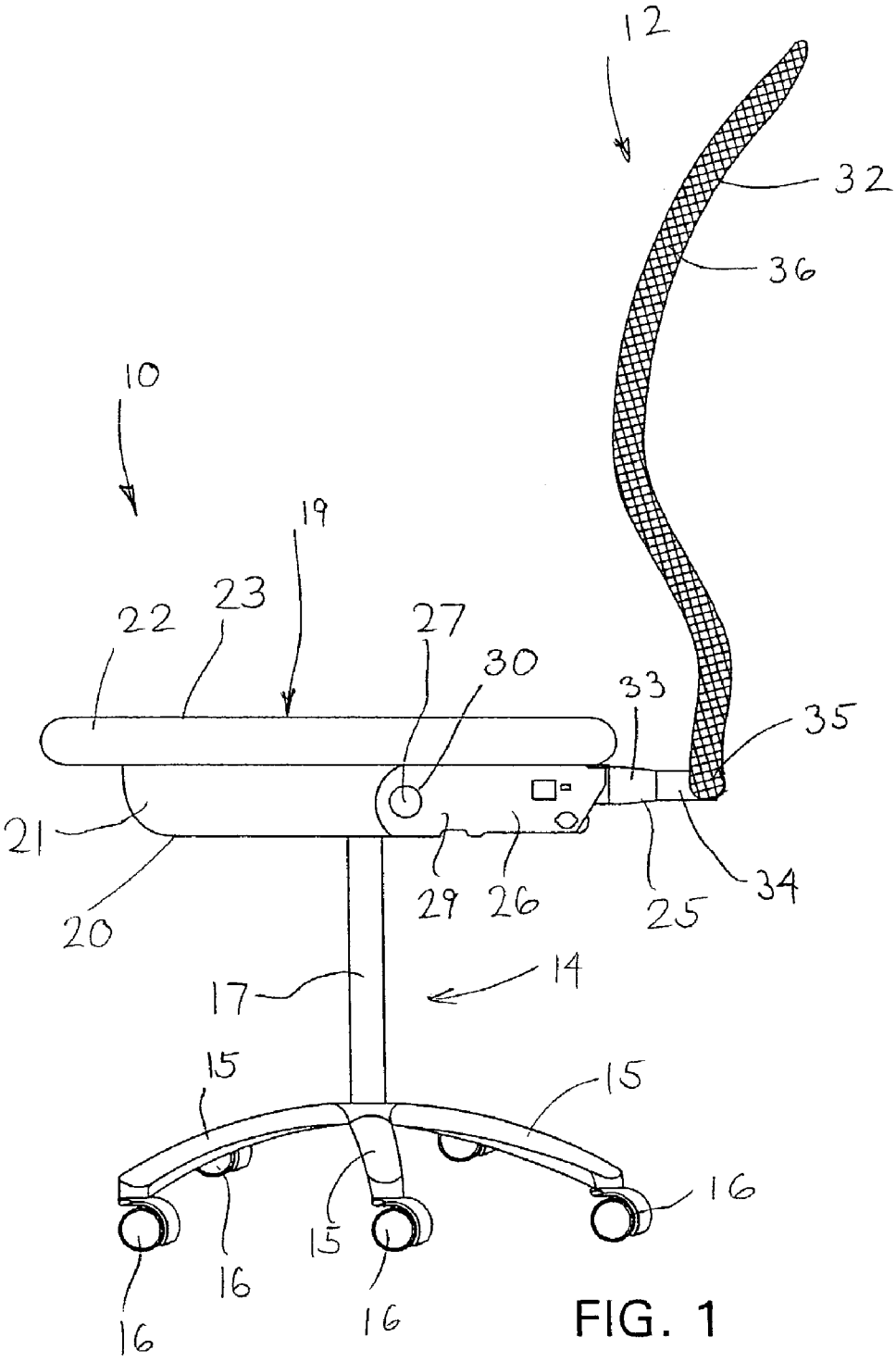
FIG. 1 is a left side elevational view of a chair according to the invention.

Certain terminology will be used in the following description for convenience and reference only, and will not be limiting. For example, the words "upwardly", "downwardly", "rightwardly" and "leftwardly" will refer to directions in the drawings to which reference is made. The words "inwardly" and "outwardly" will refer to directions toward and away from, respectively, the geometric center of the arrangement and designated parts thereof. Said terminology will include the words specifically mentioned, derivatives thereof, and words of similar import.

DETAILED DESCRIPTION

Referring to FIG. 1, the invention relates to a chair 10 having an open-mesh back assembly 12.

Generally as to the chair 10, the chair includes a base 14 comprising a plurality of legs 15 that extend radially outwardly and are supported on casters 16. The base 14 further includes an upstanding post 17.

A seat assembly 19 is supported on the post 17, which said seat assembly 19 includes a tilt control mechanism 20 which controls rearward tilting of the back assembly 12 relative to the seat assembly 19. The tilt control mechanism 20 may be of any conventional construction and is illustrated as having a control housing 21 supported on the post 17. A cushioned seat 22 is supported on the control housing 21 to provide an upward facing support surface 23 upon which a chair occupant is supported.

Figure 3:
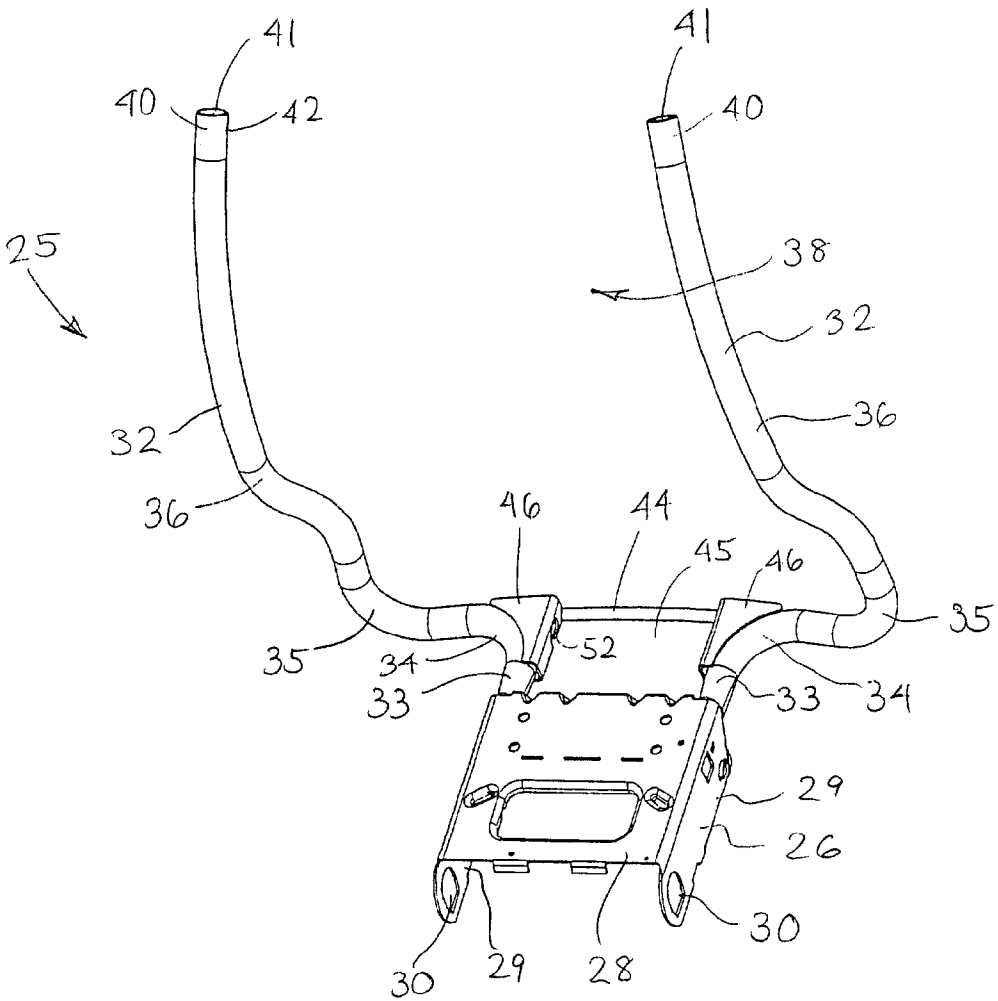
FIG. 3 is a front perspective view of the back frame.
Figure 4:
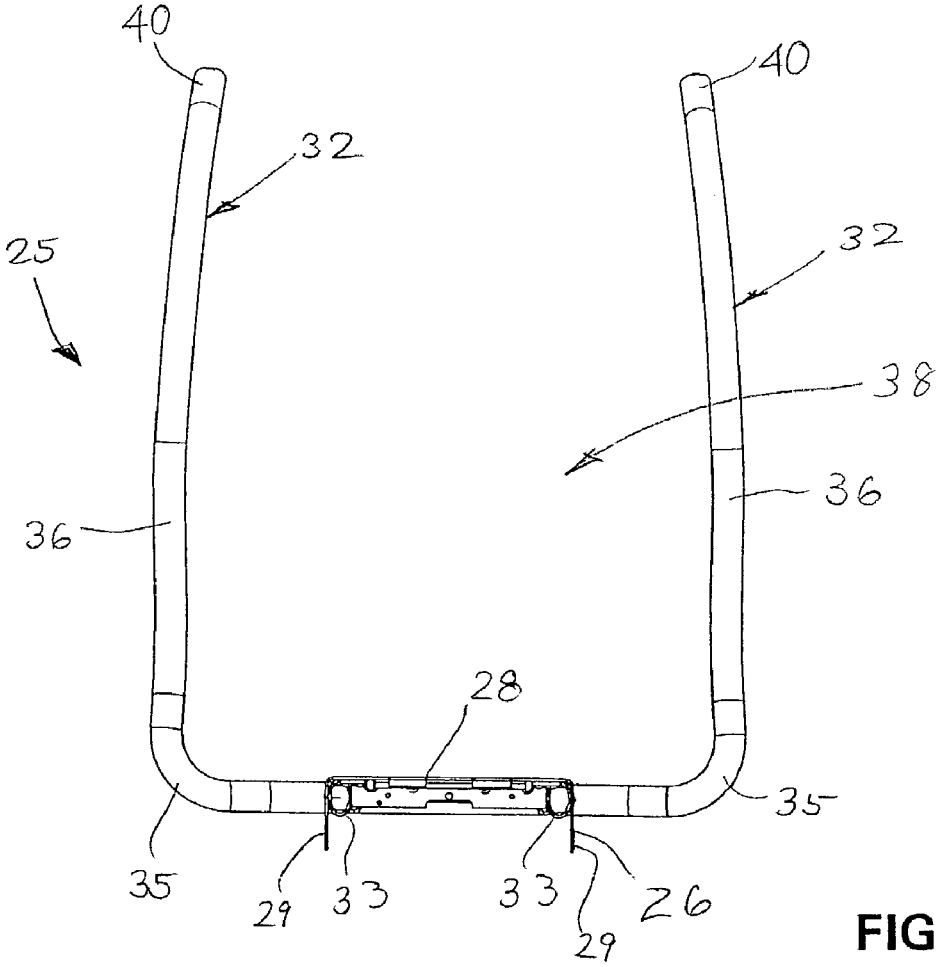
FIG. 4 is a front elevational view of the back frame.
Figure 5:
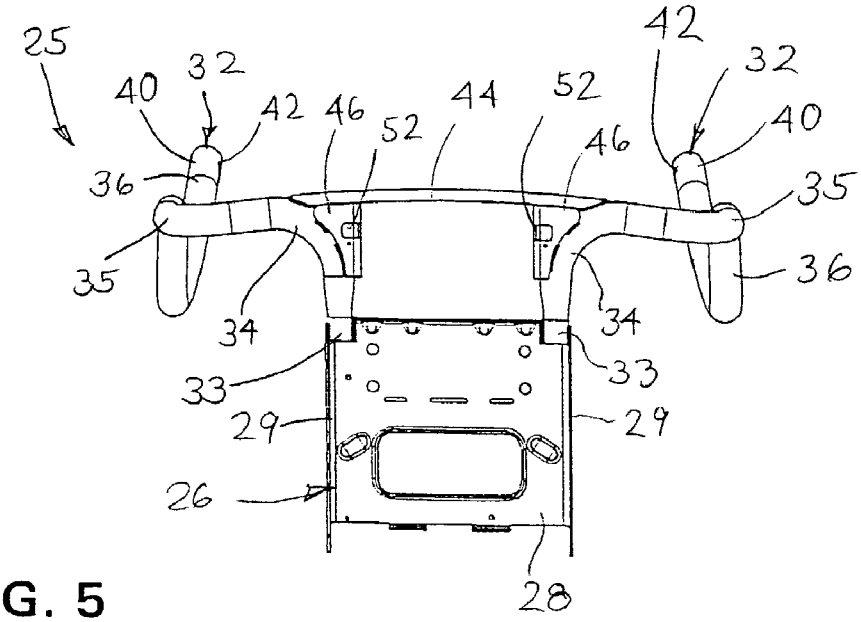
FIG. 5 is a bottom view of the back frame.

As to the back assembly 12, the back assembly 12 comprises a generally L-shaped back frame 25 which includes a horizontally-extending mounting bracket 26 that is pivotally connected to the control housing 21 by a pivot pin 27. Referring to FIGS. 3–5, the mounting bracket has a generally U-shaped, downward-opening configuration defined by a horizontal top plate 28 and downwardly depending sidewalls 29. Each sidewall 29 includes a pivot hole 30 near the front thereof through which the pivot pin 27 is pivotally connected such that the entire back frame 25 is pivotally supported on the tilt control housing 21 and tiltable rearwardly about a horizontal pivot axis. The back frame 25 therefore may pivot rearwardly, i.e., clockwise about the pivot pin 27 as viewed in FIG. 1. The pivotal connection between the mounting bracket 26 and the tilt control housing 21 is conventional and further detailed discussion as to this pivot connection is not required for an understanding of the present invention.

Referring to FIGS. 1 and 3, the L-shape of the back frame 25 is defined by tubular uprights or siderails 32 which extend rearwardly from the mounting bracket 26 and then turn upwardly in a generally vertical direction to define the contour and shape of the back assembly 12. More particularly, each side post 32 is formed substantially identical to each other except for being formed in a mirror-image. Therefore, the following discussion references one of the posts 32 although it is equally applicable to the opposite post 32.

Each post 32 has a lower horizontal section 33 which extends forwardly into the hollow interior of the mounting bracket 26 and is rigidly affixed to the bracket 26 by welding or the like. The lower section 33 projects rearwardly and then turns outwardly to the side through a sidewardly curved section 34 which then curves upwardly through an upwardly curved section 35. The upwardly curved sections 35 generally define the lower corners of the back assembly 12 as described in further detail herein.

The curved sections 35 then extend upwardly and transition into vertical side sections 36. The side sections 36 are provided with a contoured shape that generally defines the overall curvature and outline of the back assembly 12. The side sections 36 not only may curve forwardly and rearwardly as seen in FIG. 1 but also inwardly or outwardly in the side-to-side direction as seen in FIG. 4. Referring to FIGS. 3 and 4, the side sections 36 thereby are spaced sidewardly apart from each other to define an open interior region or back opening 38 which is the primary area in which the back of the chair occupant will be located and supported by the back assembly 12 as described in further detail herein.

Figure 12:
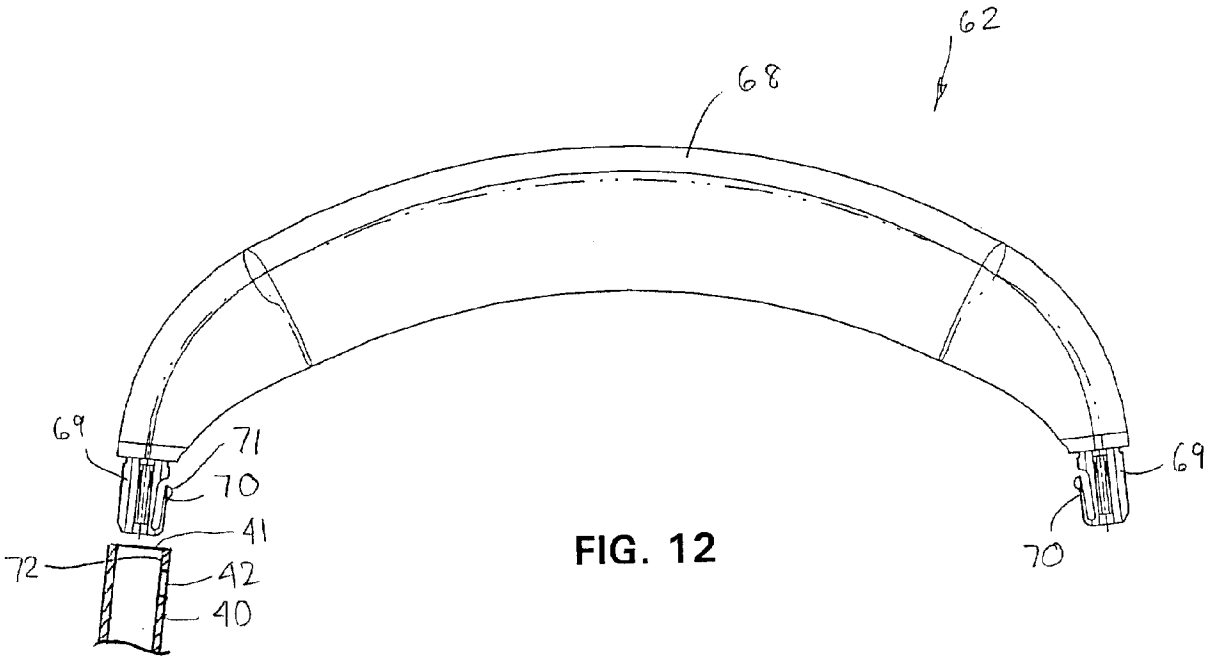
FIG. 12 is a front view of a first crossbar construction with upper ends of the back frame illustrated in cross-section.

Referring to FIGS. 3 and 12, the upper end 40 of each side section 36 is formed with a tubular shape that defines an upper opening 41. The inner sidewall of the upper end 40 also is formed with a rectangular lock notch 42 opening sidewardly through the entire thickness of the wall.

To provide lateral support to the siderails 32 and rigidify the back frame 25, a horizontal cross-brace 44 is provided with its opposite ends rigidly connected to the curved sections 34. The cross-brace 44 has a central section which spans the open area 45 disposed between the lower rail sections 33.

Figure 24:
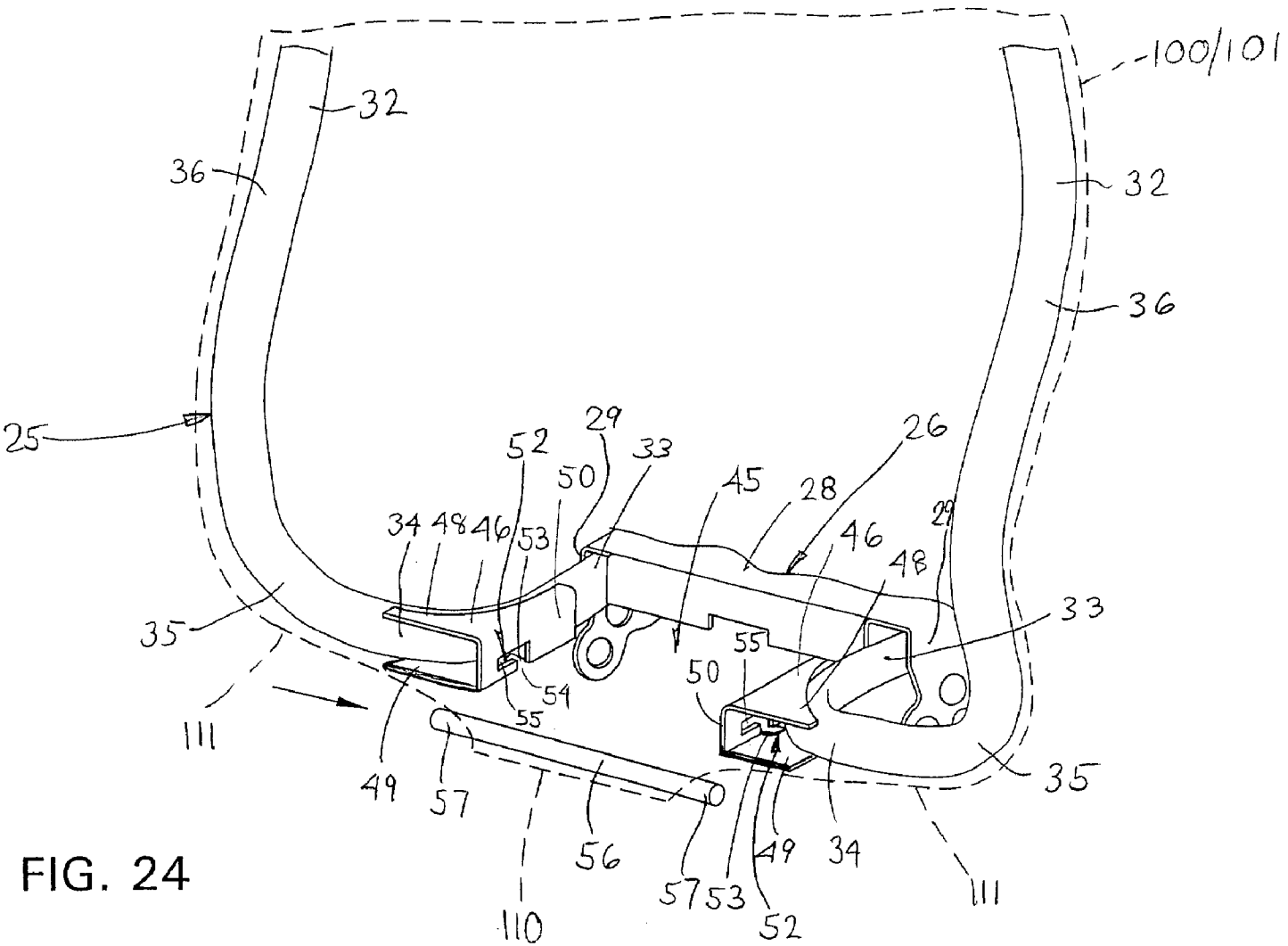
FIG. 24 illustrates the fabric cover with a retaining rod slid into nested engagement with a lower hem of the cover.
Figure 25:
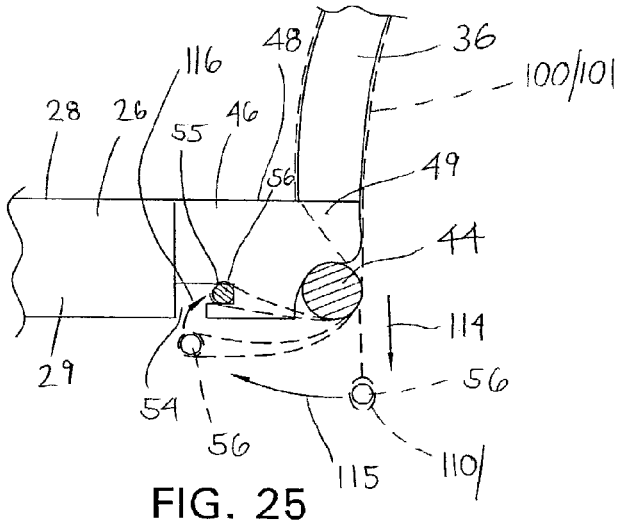
FIG. 25 is a side cross-sectional view illustrating the retaining rod being swung forwardly into engagement with a locking bracket.
Figure 26:
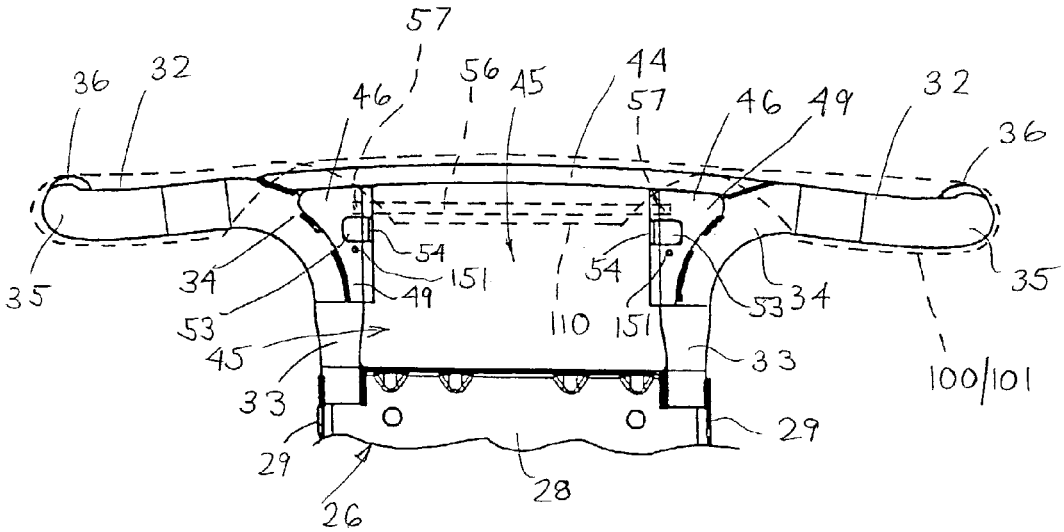
FIG. 26 is a bottom view of the retaining rod fully engaged with the locking bracket.

Additionally, retainer brackets 46 are mounted to each curved section 34 as seen in FIGS. 3 and 24–26. Each retainer bracket 46 has a generally triangular shape when viewed from below as seen in FIG. 26, and is defined by upper and lower walls 48 and 49 and an interior sidewall 50.

Each retainer bracket 46 also includes a connector notch 52 having a three-dimensional shape formed in the lower wall 49 and sidewall 50. More particularly, each notch 52 includes a horizontal bottom portion 53 which is formed in the lower bracket wall 49 as seen in FIG. 26. The notch 52 then further includes a vertical portion 54 which is formed in the sidewall 50 and extends continuously vertically from the inner end of the bottom portion 53 as seen in FIGS. 25 and 26. The notch 52 also includes a horizontal top portion 55 which extends rearwardly from the upper end of the vertical portion 54 as seen in FIG. 25 to generally define an inverted L-shape in the sidewall 50.

The back assembly 12 also includes a retaining rod 56 (FIGS. 23 and 24) which is adapted to span the open space 45 between the horizontal rail sections 33 and also have its opposite ends 57 seat within a respective notch 52 of a retainer bracket 46. As seen in FIG. 24, the retaining rod 56 is a separate component which is positionable in a horizontal orientation. The lateral spacing between the bottom notch portions 53 is sufficient to allow the opposite ends 57 of the retaining rod 56 to be slid vertically upwardly into the notches 52 as generally illustrated in FIGS. 25 and 26. The retaining rod 56 is slid vertically along the vertical notch portions 54 and then slid rearwardly along the horizontal notch portions 55 such that the retaining rod 56 is supported vertically within the horizontal notch portions 55 as seen in FIG. 25. The purpose of the retaining rod 56 is described in further detail hereinafter.

Figure 2:
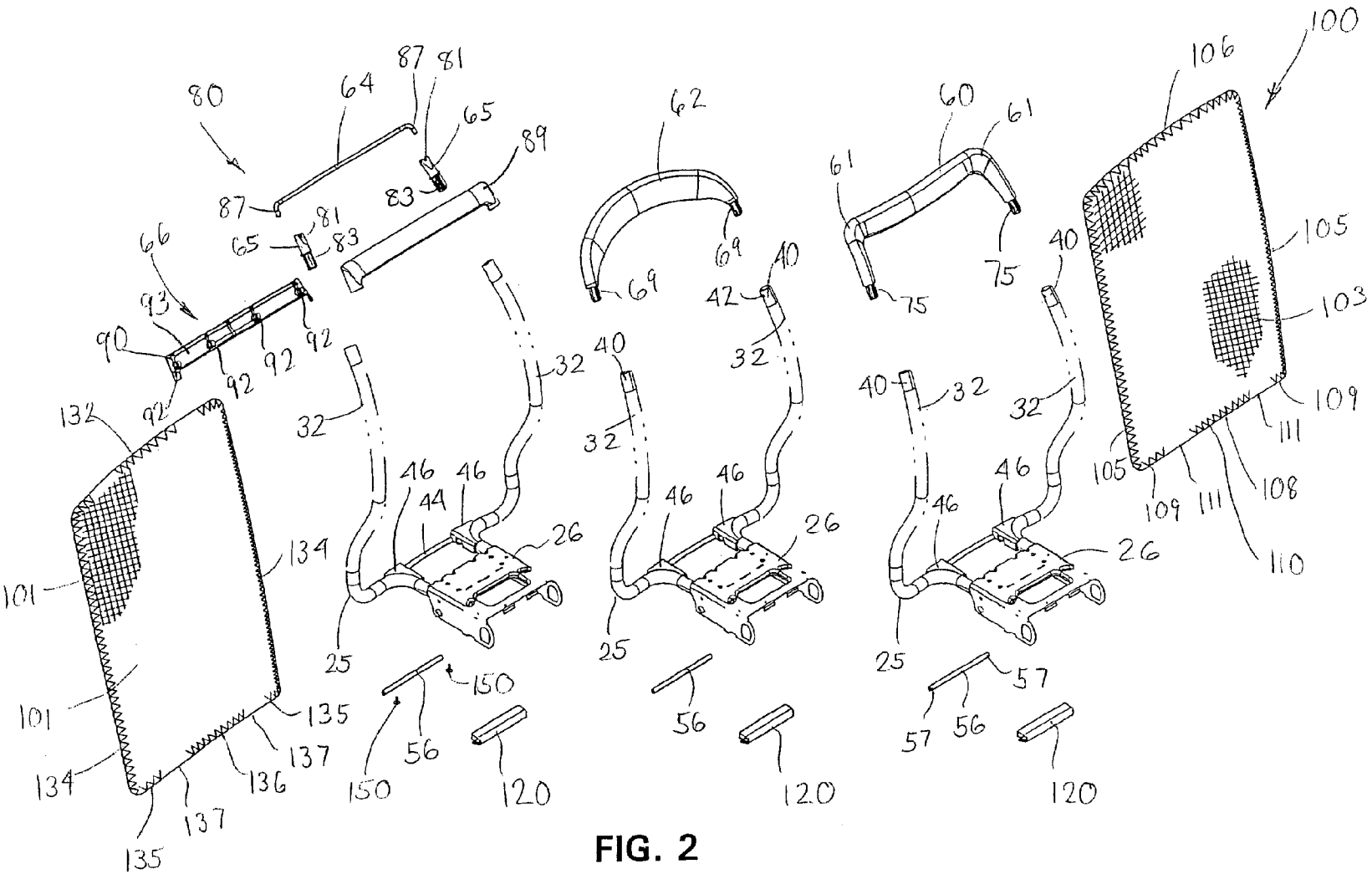
FIG. 2 is a perspective exploded view illustrating a universal back frame, three alternate embodiments of a crossbar for the back frame, and two alternate embodiments of a flexible fabric cover therefore.

The back assembly 12 additionally includes an interchangeable crossbar arrangement or spreader arrangement at the upper ends 40 of the siderails 32. Referring to FIG. 2, three different crossbar embodiments are illustrated including a generally right-angle crossbar 60 wherein the corners 61 thereof have a right-angle shape. An additional curved crossbar 62 may alternatively be provided wherein the crossbar 62 is structurally and functionally the same as the crossbar 60 except for the overall aesthetic appearance thereof. Still further, a third rod-type crossbar 64 may be provided in combination with connector plugs 65 which permit the crossbar 64 to be supported on the siderails 32 and with a trim arrangement 66 which overlies the crossbar 64 and provides a finished aesthetic appearance.

Figure 13:
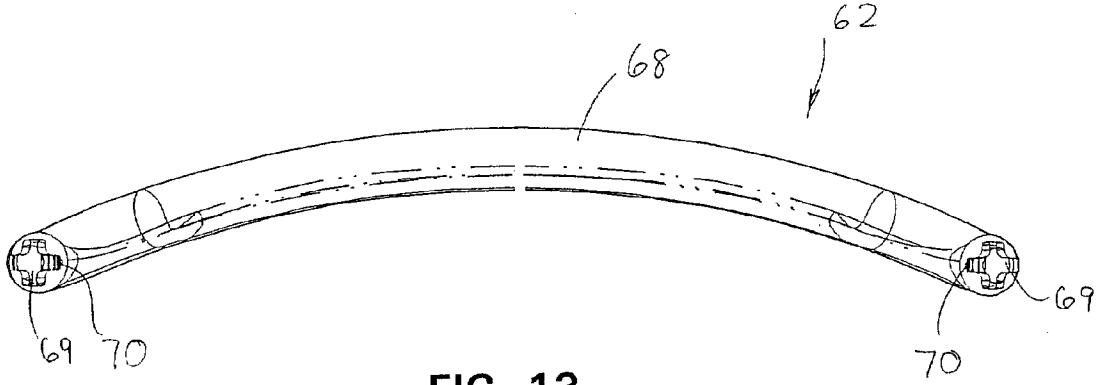
FIG. 13 is a bottom view of the crossbar of FIG. 12.

Turning first to the curved crossbar 62 illustrated in FIGS. 12 and 13, the crossbar 62 is formed with a main body 68 that is generally arch-shaped as seen in FIG. 12 and also curves forwardly as seen in FIG. 13. The main body 68 is formed of a suitable molded material such as plastic. The main body 68 on the opposite lower ends thereof includes inserts 69 which are adapted to fit downwardly within the upper opening 41 on each rail end 40. The insert 69 has an x-shaped cross-section as viewed from below in FIG. 13 which is adapted to be frictionally engaged within the tube end 40 in tight fitting engagement therewith. The insert 69 also includes a cantilevered locking finger 70 which projects vertically (FIG. 12) and inwardly, and has a projection 71 at the free end of the finger 70. The finger 70 is able to deflect inwardly as the projection 71 slides along the interior surface 72 of the rail end 40. When the insert 69 is fully seated within the opening 41, the projection 71 is able to snap sidewardly into the lock notch 42 to prevent inadvertent removal of the crossbar 62.

As such, the crossbar 62 is able to snap into the upper ends 40 of the siderails 32 such that the back frame 25 thereby has a generally rectangular configuration that is sized to support the entire back of a chair occupant. Additionally, the inserts 69 of the crossbar 62 are laterally spaced apart a sufficient distance so as to maintain the siderails 32 in a fully spread condition and prevent inward flexing of the siderails 32.

Figure 14:
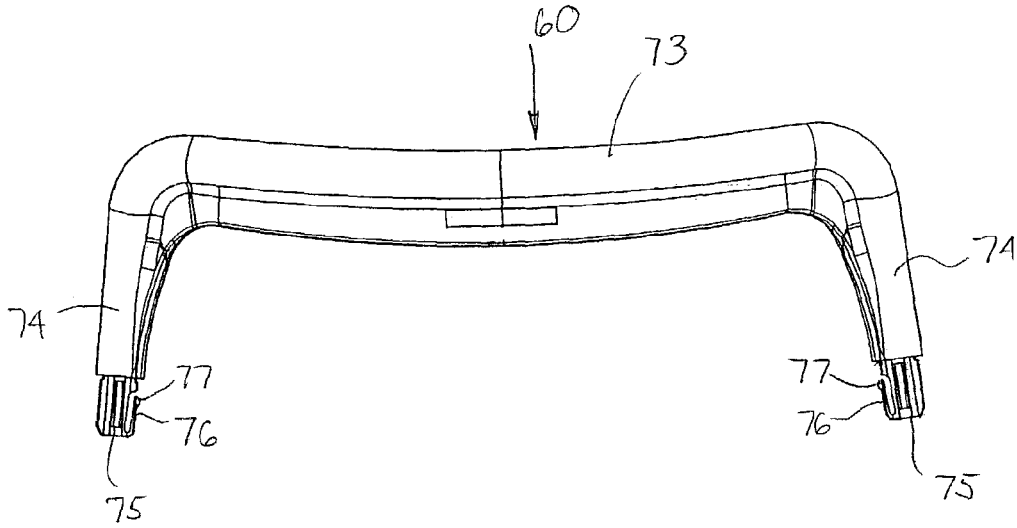
FIG. 14 is a front view of a further embodiment of a crossbar having an alternate shape.

Referring to FIG. 14, the crossbar 60 is structurally and functionally equivalent to the crossbar 62. The crossbar 60 includes a horizontally elongate main body 73 having downwardly depending vertical sections 74. The main body 73 includes inserts 75 at the lower ends of the vertical sections 74 which inserts 75 are formed identical to the inserts 69 and structurally cooperate and lock into the upper rail ends 40 as described above relative to FIGS. 12 and 13. The primary difference between the crossbar 60 and the crossbar 62 is that the crossbar 60 has a more right-angle shape as opposed to the enhanced curvature provided in the crossbar 62. The main body 73 of the crossbar 60 also is similar to the main body 68 in that it curves generally rearwardly to conform to the shape of a chair occupant's back.

The inserts 75 further include cantilevered resilient fingers 76 having a lock projection 77 on the upper most end thereof.

Figure 22:
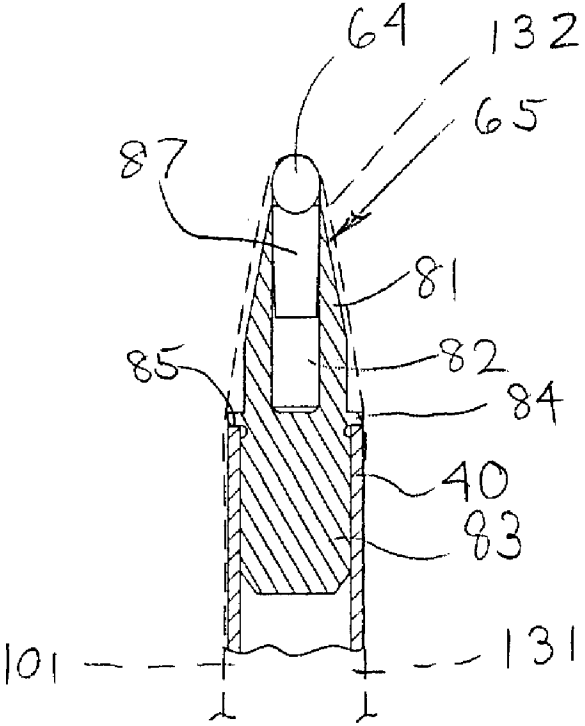
FIG. 22 is an end cross-sectional view of the upper corner connection.
Figure 21:
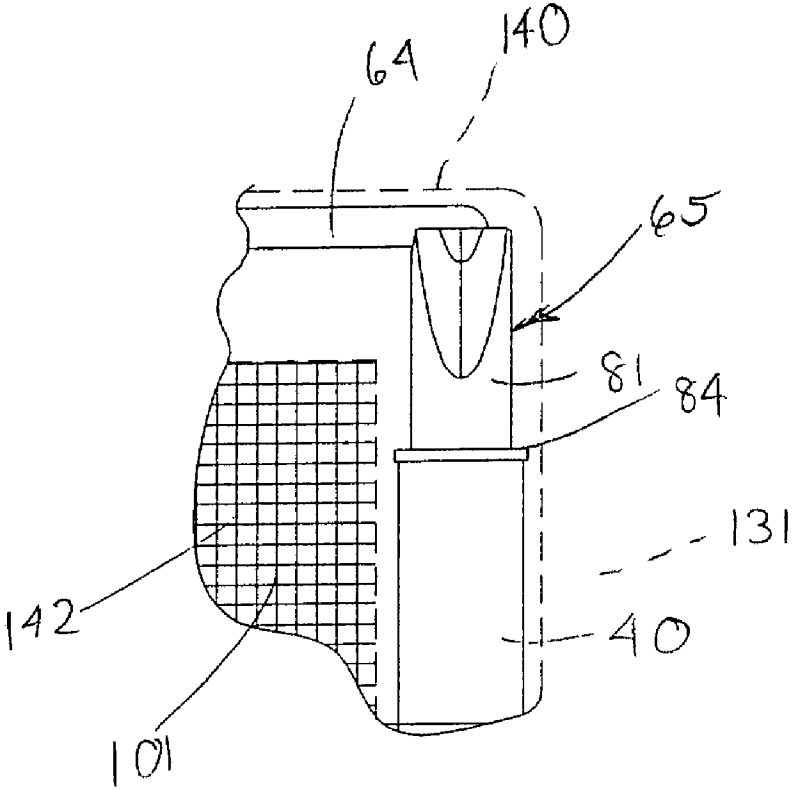
FIG. 21 is a front view illustrating the upper corner connection of the crossbar and the back frame.

Turning next to the crossbar 64, the crossbar 64 is provided as part of an overall crossbar assembly 80 comprising the aforementioned crossbar 64, the connector plugs 65 and the trim arrangement 66. Referring to FIGS. 2, 21 and 22, the connector plug comprises a crossbar support section 81 which is formed with a blind bore 82 projecting downwardly therein. The support section 81 tapers upwardly as seen in FIG. 22 with the open upper end of the bore 82 adapted to receive one end of crossbar 64 therein.

The plug 65 further includes a connector insert 83 which is formed substantially identical to the insert 69 described above. The insert 83 includes a cantilevered finger with a projection that is adapted to engage the lock notch 42 formed in the upper rail end 40 in the same manner as that generally illustrated in FIG. 12. As seen in FIG. 22, the insert 83 seats within the upper rail end 40 and has an annular rim 84 which is supported vertically on the upper edge 85 of the upper rail end 40. The connector plug 65 therefore serves as an adapter to accommodate a different type of crossbar, namely the rod-type crossbar 64.

The crossbar 64 is formed of a steel rod that is bent at its opposite ends to define a connector flange 87 at each opposite end that is adapted to slide vertically downwardly into and be seated within the bore 82. The crossbar 64 not only defines rectangular shape for the back frame 25 but also maintains the siderails 32 in the spread position.

Figure 20:
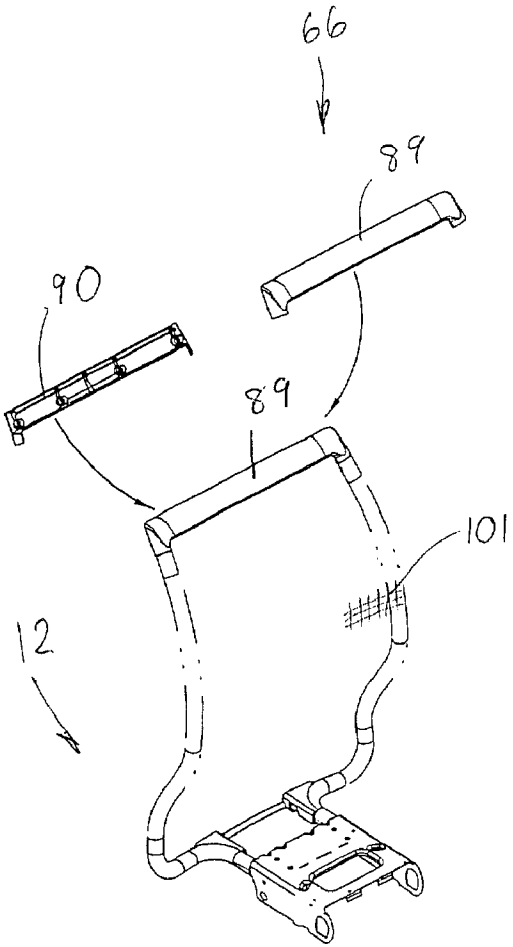
FIG. 20 is a perspective view of the back frame assembly with upper trim pieces shown prior to and after installation.

The crossbar assembly 80 further includes the trim arrangement 66 which comprises a horizontally-elongate front trim piece 89 and a rear trim piece 90. The trim pieces 89 and 90 include cooperating connector parts which allow the trim pieces 89 and 90 to be snap locked together with the crossbar 64 sandwiched therebetween. The cooperating locking parts preferably include snap posts 92 which project forwardly from an inside face 93 of the rear trim piece 90. Preferably the posts 92 are adapted to snap into respective openings on the opposing inside face of the front trim piece 89. When snapped together the trim pieces 89 and 90 define an exposed upper edge section for the back assembly 12 as seen in FIG. 20.

With the foregoing components, three different back assemblies can be formed by providing one common back frame, in combination with the different, removable and interchangeable crossbars 60, 62 and 64. The different crossbars 60, 62 and 64 define different aesthetic shapes and appearances for the back assembly 12 and are readily interchangeable and held in place without separate fasteners. As such, the construction of different chairs 10 can be readily varied during manufacture depending upon the crossbar construction being used.

In addition to the foregoing frame arrangement, the back assembly 12 includes a fabric cover arrangement which overlies the back frame 25 and completes the finished aesthetic appearance of the back assembly 12. Referring to FIG. 2, the cover arrangements include either a dual-layer fabric cover 100 which is useable with the crossbar 60 or 62, or a single-layer cover 101 which is useable with the crossbar 64. For both covers 100 and 101, the covers are formed of a resiliently stretchable or elastomeric material, and open interior pocket sections of the covers are adapted to receive the frame siderails 32 and the crossbars 60, 62 or 64 therein. The covers 100 and 101 generally are formed of a resiliently stretchable open-mesh material wherein the lower edge of the covers 100 or 101 are stretched downwardly and then fixed to the back frame 25 to maintain the cover material taut and pull downwardly on any of the crossbars 60, 62 or 64 to help retain the crossbars in fixed engagement with the siderails 32.

Figure 9:
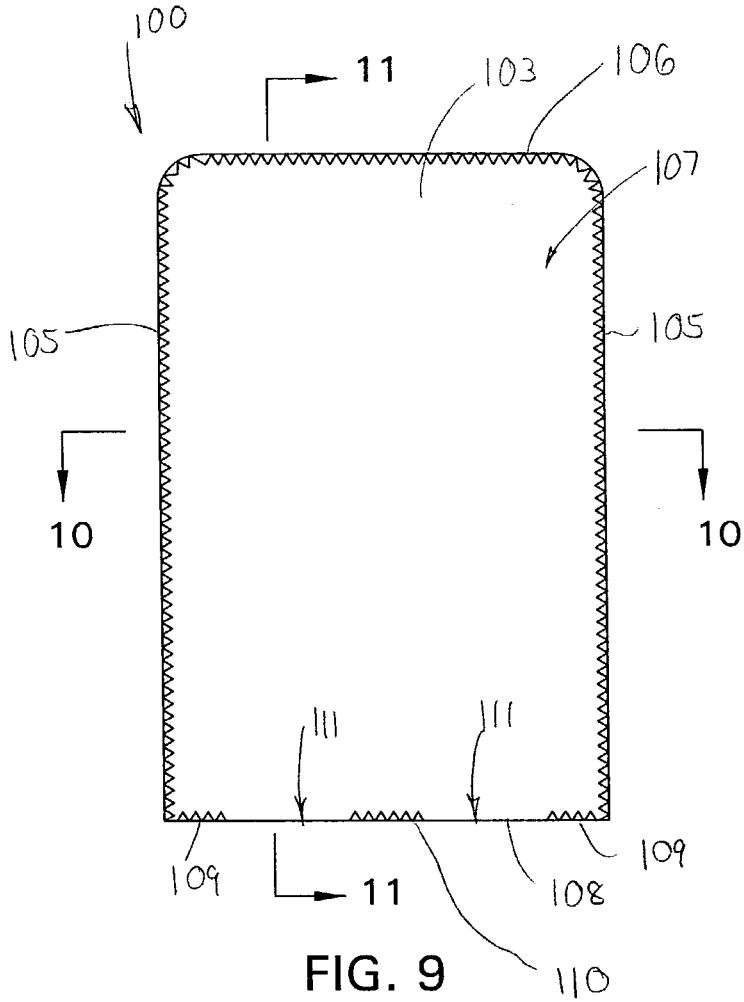
FIG. 9 is a front view of a multi-layer fabric cover.
Figure 11:
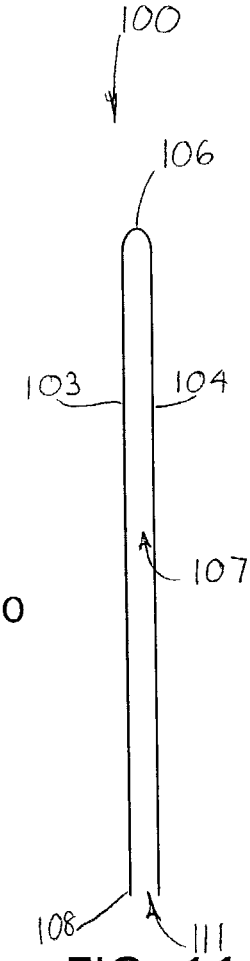
FIG. 11 is a side cross-sectional view of the fabric cover as taken along line 11—11 of FIG. 9.
Figure 10:
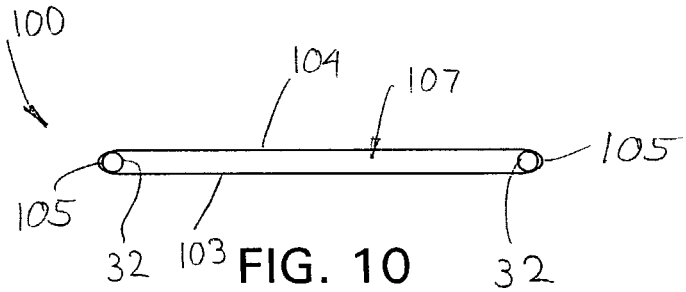
FIG. 10 is a top cross-sectional view of the cover mounted on the back frame as taken along line 10—10 of FIG. 9.

More particularly as to the dual-layer cover 100 as diagrammatically illustrated in FIGS. 9–11. The cover 100 basically performs as an elastomeric fabric sock which fits over the back frame 25 and provides the finished aesthetic surfaces thereof. The cover 100 is formed of an elastomeric open-mesh material which is resiliently stretchable to tight fittingly conform to the shape of the back frame 25 and the contours provided by the siderails 32. Further, the cover 100 is adapted to overlie the open area 38 defined between the siderails 32 and thereby resiliently support the occupant's back.

The cover 100 is diagrammatically illustrated in FIGS. 9–11 as having first and second layers 103 and 104 which are joined together along the entirety of the side edges 105 and top edge 106 and a portion of the bottom edge 108. More particularly, the fabric layers 103 and 104 are hemmed or seamed along the opposite side edges 105 and the top edge 106 to thereby define an open interior or pocket 107 between these opposing layers 103 and 104.

As for the bottom edge 108, the seams or hems extend partially from the lower most corners along end portions 109 while a central portion 110 also is hemmed. This thereby defines two openings 111 which open into the hollow interior 107 and provide access thereto. The central hem portion 110 also serves as an engagement point which engages the retaining rod 56 to fixedly secure the bottom edge 108 to the retainer brackets 46 of the back frame 25 as will be discussed in greater detail herein.

Figure 15:
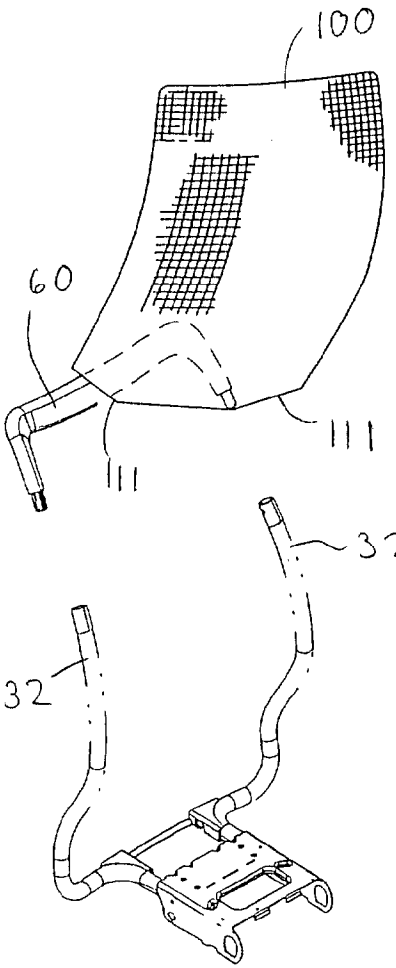
FIG. 15 is an exploded view of the fabric cover construction of FIG. 9 being installed on the back frame with the crossbar of FIG. 14.
Figure 16:
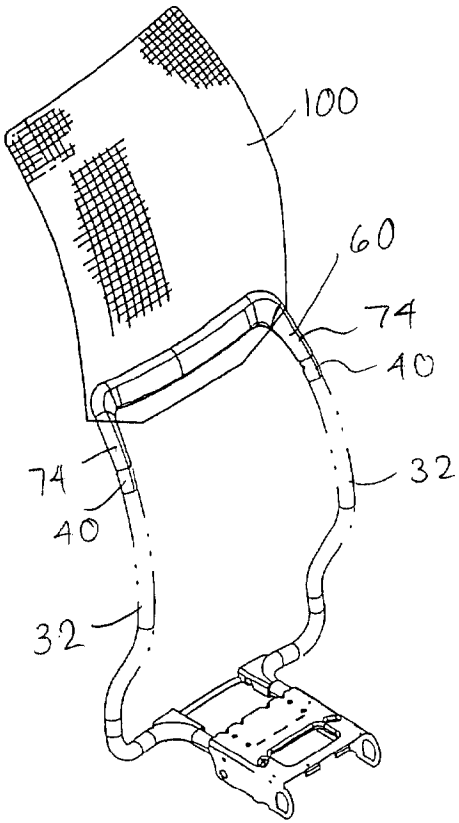
FIG. 16 is a perspective view of the crossbar installed on the side rails with the fabric cover in a raised position.
Figure 17:
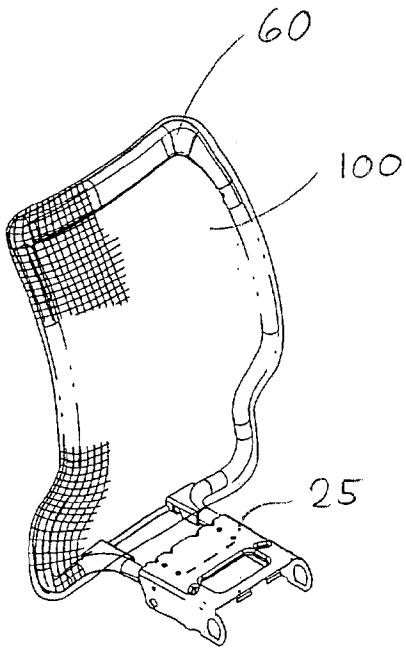
FIG. 17 is a perspective view of the back frame assembly with the fabric cover lowered to an installed position.

Assembly of the cover 100 to the back frame 25 is diagrammatically illustrated in FIGS. 15–17. Generally, the cover 100 is adapted to completely enclose the siderails 32 any of the crossbars 60 or 62 within the open interior 107. Since the cover 100 is completely closed along the side edges 105 and top edge 106 and partially enclosed across the bottom edge 108, installment of the cover 100 is accomplished through the steps illustrated in FIGS. 15–17.

First, the crossbar 60 has one end inserted into one of the openings 111 and then threaded out of the other opening 111 such that the opposite ends of the crossbar 60, such as the end portions 74, project downwardly from the openings 111. The inserts 75 on the crossbar 60 are then plugged into the openings 41 formed in the siderails 32 which then traps the cover 100 on the back frame 25. Thereafter, the cover 100 is slid downwardly so as to completely enclose the back frame 25 as seen in FIG. 17. To complete installation of the cover 100, the lower edge 108 thereof is fixedly attached to the retainer brackets 46 as diagrammatically illustrated in FIGS. 23–25.

Figure 23:
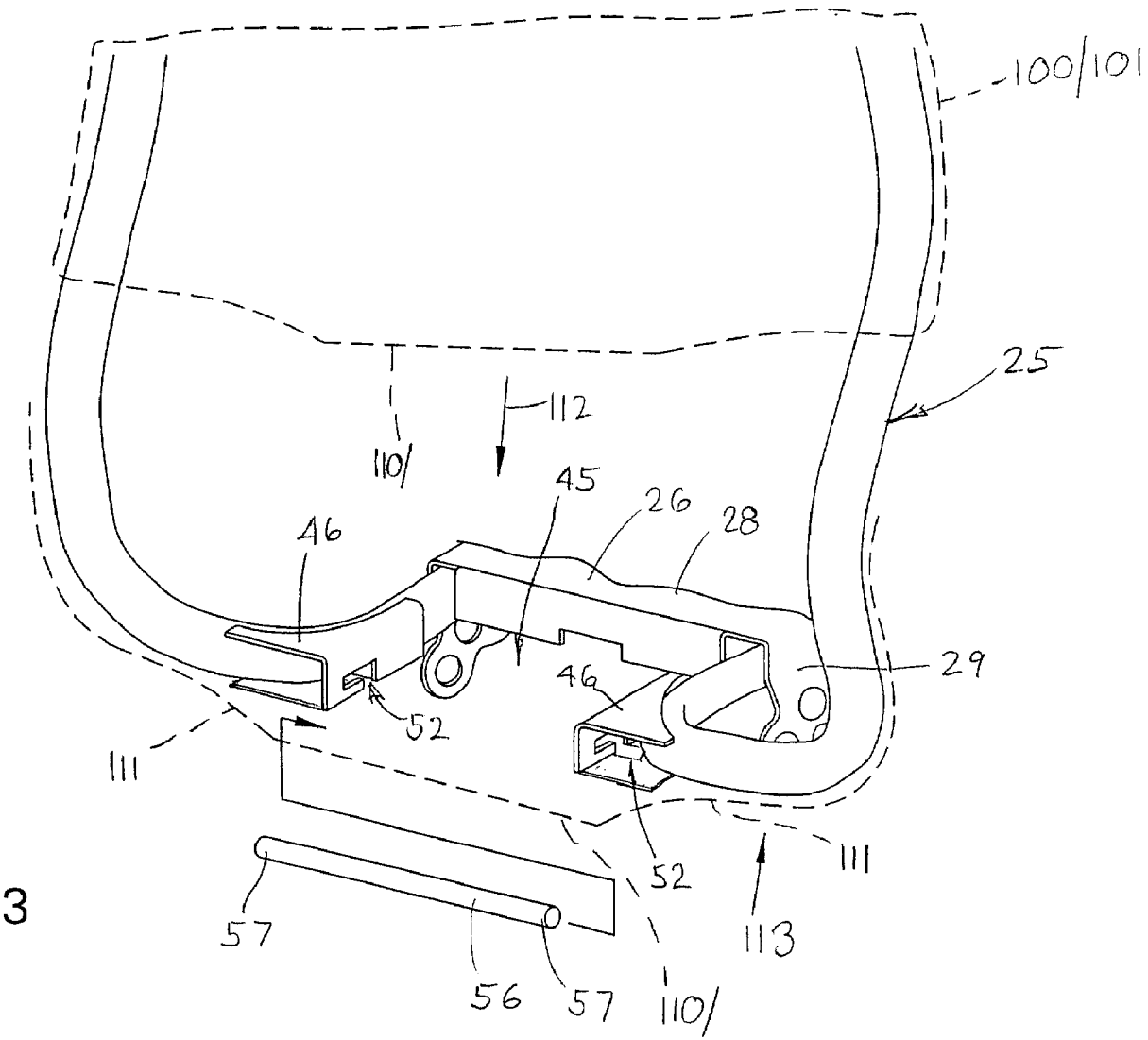
FIG. 23 is a rear perspective view showing a fabric cover illustrated in phantom outline in a raised, partially installed position and a lowered, installed position.

As seen in FIG. 23, the cover 100 is slid downwardly as indicated by reference arrow 112 to the fully installed position designated by reference arrow 113. In this configuration, the central hem section 110 hangs downwardly while the retaining rod 56 is then inserted into one opening 111 until the opposite ends 57 project outwardly from the opposite sides of the central hem section 110 as seen in FIG. 24. Referring now to FIG. 25, the retaining rod 56 when engaged with the central hem section 110 is pulled downwardly as indicated by reference arrow 114 such that the overall fabric material of the cover 100 is stretched taut. Thereafter, the retaining rod 56 is swung forwardly as indicated by reference arrow 115 and then seated within the connector notches 52 as indicated by reference arrow 116. The cover material 100 therefore extends rearwardly and then wraps forwardly about the cross brace 44 so that the back is fully enclosed by the cover material 100 as seen in the various Figures including FIG. 26. With this arrangement, the only retaining device holding the cover 100 in position as well as holding the crossbar 60 or 62 in place on the siderails 32 is the retaining rod 56 and the resilient stretching of the fabric material.

Figure 27:
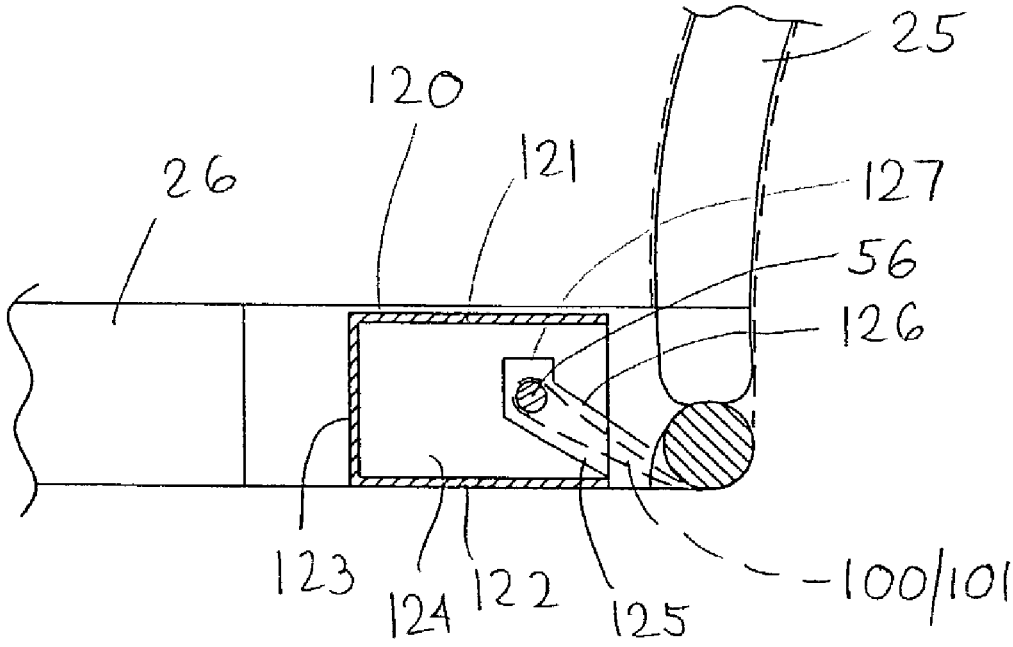
FIG. 27 is a side cross-sectional view illustrating a cover bracket positioned on the retaining rod.

Referring to FIG. 27, a cover channel 120 is provided having upper and lower walls 121 and 122, a forward wall 123 and opposite sidewalls 124. The sidewalls 124 include an engagement channel 125 having an entry section 126 and a vertical interior section 127. The cover channel 120 thereby fits rearwardly over the retaining rod 56 and is locked in place thereon to enclose the arrangement of the retaining rod 56.

The cover 100 thereby may fit onto either of the crossbars 60 and 62. Due to the resiliency of this cover 100, the upper cover edge 106 is adapted to stretch and conform to the different geometric configurations of the crossbars 60 and 62.

Figure 6:
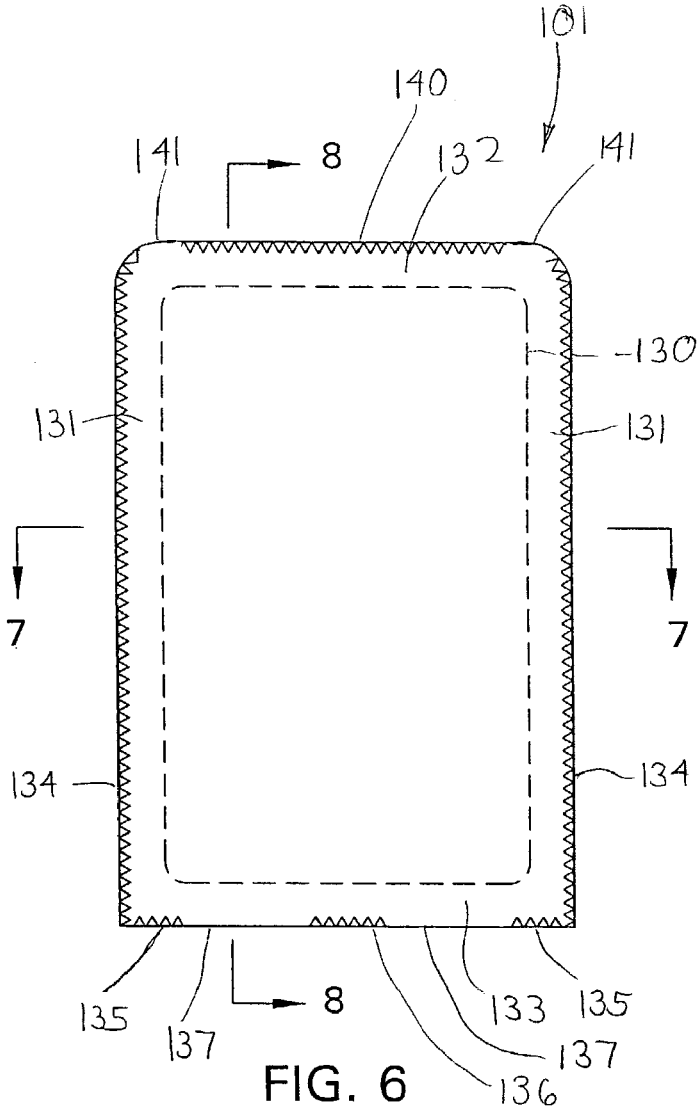
FIG. 6 is a front view of the first embodiment of the fabric cover.
Figure 8:
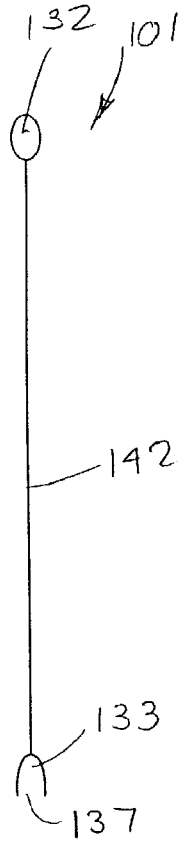
FIG. 8 is a side view of the cover as taken along line 8—8 of FIG. 6.
Figure 7:
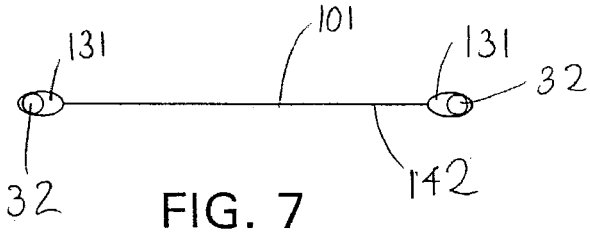
FIG. 7 is a top cross-sectional view of the fabric cover assembled on the back frame as taken along line 7—7 of FIG. 6.

As for the single-layer cover 101, this cover is illustrated in FIGS. 6–8. In this single-layer cover 101, the same fabric material is used except that it is hemmed so as to define a tubular pocket extending about the entire periphery of the cover 101. The tubular pocket is defined by a rectangular hemline 130 which forms vertical side pockets 131, a horizontal top pocket 132 and a horizontal bottom pocket 133. The side pockets 131 are completely enclosed along the vertical side edges 134 while the bottom pocket 133 has opposite end hem portions 135 and a central hem portion 136 which are formed substantially the same as the hem portions 108 and 109 on the cover 100. The lower portion of the cover 101 thereby functions and is connected to the back frame 25 similar to the cover 100 as will be described in further detail herein.

With this arrangement, a pair of laterally spaced apart pocket openings 137 are formed on the opposite ends of the central hem section 136. The upper pocket 132 functions similar to the cover 100 in that it receives the crossbar horizontally therein and holds the crossbar 64 on the siderails 32. However, since the hemline 130 prevents insertion of the crossbar 64 through the openings 137 and sliding upwardly to the upper cover edge 140, the upper edge 140 of the cover 101 is formed with a pair of relatively small crossbar openings 141 in the seam near the upper corners thereof. Therefore, the cover 101 functions similar to the cover 100 in that a crossbar 64 is received within an open interior portion or pocket of the cover 100 through appropriate corner openings. However, the corner openings are defined by openings 141 at the top corners while separate bottom openings 137 are provided to accommodate the retaining rod 56 as described further herein.

When installed, the cover 101 defines a body support area 142 which completely overlies the open region 38 between the uprights 32 to support the occupant's back.

Figure 19:
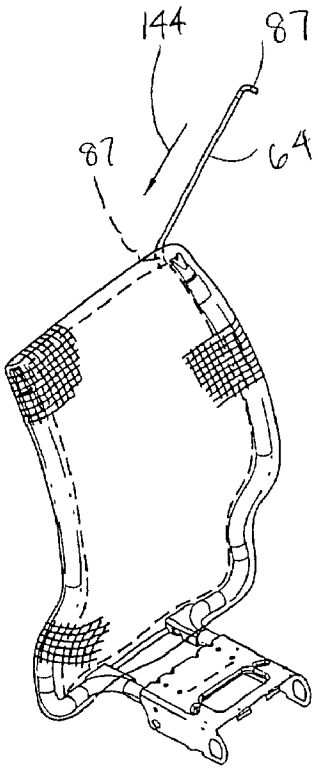
FIG. 19 is a perspective view of the fabric cover slid downwardly to a lowered position with a crossbar being slid into an upper hem pocket of the fabric cover.
Figure 18:
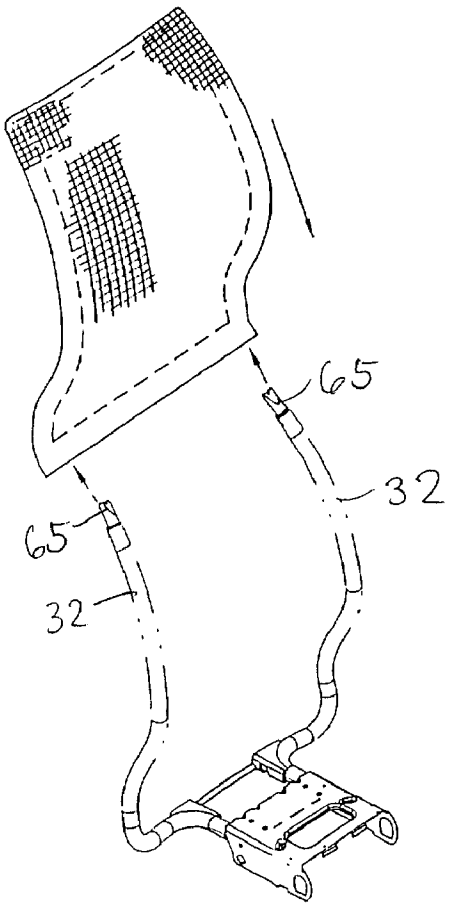
FIG. 18 is a perspective view of the back frame with the fabric cover of FIG. 6 illustrated in a raised position and aligned for installation on the side rails of the back frame.

To install the cover 101, the installation steps are illustrated in FIGS. 18-20. Referring to FIG. 18, the siderails 32 include the plugs 65 thereon wherein the upper ends of the siderails 32 are inserted into the side pockets 131 through the lower corner openings 137. With the cover 101 in a relatively loose condition, one end of the crossbar 64 is inserted into the upper right corner opening 141 as indicated by reference arrow 144 and then slid horizontally through the top pocket 132 until the crossbar 64 is enclosed entirely within this top pocket 132. The opposite crossbar ends 87 thereby align with and then are inserted downwardly into engagement with the plugs 65 as generally illustrated in FIGS. 21 and 22.

Thereafter, the lower end of the cover 101 is pulled downwardly over the entire back frame 25 similar to the cover 100 described above. At the top edge 140, the trim pieces 89 and 90 are snapped over the exterior of the cover 101 to enclose the corner openings 141 as well as the crossbar 64 and end plugs 65 which may be visible therethrough.

At the lower edge, the central hem portion 136 and the openings 137 are adapted to receive the retaining rod 56 therethrough in the same manner as the cover 100 and therefore, the structure and assembly steps illustrated in FIGS. 23–27 are also applicable to the cover 101 and are not described in greater detail herein. Referring to FIG. 2, however, fasteners 150 may be snapped through the cover material 101 into engagement with the fastener openings 151 illustrated in FIG. 26 which thereby holds the cover 101 in place and ensures that the cover 101 completely encloses the lower structure of the back frame 25. The cover channel 120 (FIG. 27) then is positioned in place on the retaining rod 56 to further finish the aesthetic appearance of the back frame 25.

In operation, the back assembly 12 provides an improved construction which may be readily assembled and manufactured using a common back frame 25, different style crossbars 60, 62 or 64 and an appropriate cover 100 or 101. Assembly of the back assembly 12 is accomplished without the use of separate fasteners or the like and only requires a retaining rod 56 which is held in place due to the resilient stretching force generated by the covers 100 or 101. This provides for easy assembly and a cover 100 or 101 which readily conforms to the shape of the back frame 25.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A chair comprising:

a base;

a seat supported on said base; and a back assembly having a rigid back frame supported on said seat, said back frame comprising a plurality of side rails projecting vertically above said seat in laterally spaced relation, and a crossbar having opposite ends removably engagable with upper ends of said side rails, said back assembly further comprising a mounting bracket near a lower edge of said back assembly and a flexible cover adapted to support a back of a chair occupant, said cover comprising interior side pockets, a top pocket and a bottom pocket, a lower edge of said cover at least including lower openings which open into said bottom pocket and are laterally spaced apart with a central hem section defined therebetween, said cover being secured on said back frame wherein said side rails are received vertically in said side pockets through said lower openings and said crossbar extends horizontally within said top pocket, said back assembly including a retaining member which is held within said lower pocket by said central hem section and has opposite ends which project out of said lower openings and engage said mounting bracket to prevent removal of said cover.

2. The chair according to claim 1, wherein an open area is defined laterally between said side rails, and said cover overlies said open area.

3. The chair according to claim 2, wherein said cover is formed of an open mesh material.

4. The chair according to claim 2, wherein said cover is resiliently flexible and is held in tension by engagement of said retaining member with said mounting bracket.

5. The chair according to claim 4, wherein said mounting bracket includes notches that open forwardly, said cover being stretched to permit sliding of said retaining member into engagement with said notches wherein the resiliency of said cover pulls said retaining member rearwardly into said notches.

6. The chair according to claim 5, wherein said cover is formed of an elastomeric mesh material.

7. The chair according to claim 1, wherein said top, bottom and side pockets define portions of a single open interior of said cover.

8. The chair according to claim 1, wherein said top, bottom and side pockets extend end to end such that a single layer of cover material is defined between said top, bottom and side pockets.

9. A chair comprising:

a base;

a seat supported on said base; and a back assembly having a rigid back frame supported on said seat, said back frame comprising a plurality of side rails projecting vertically above said seat in laterally spaced relation, and a cross bar having opposite ends removably engagable with upper ends of said side rails, said back assembly further comprising a mounting bracket arrangement near a lower edge of said back assembly and a flexible cover adapted to support a back of a chair occupant, said cover comprising interior side pockets adapted to receive said side rails, a top pocket adapted to receive said crossbar and a bottom pocket which said pockets are closed along outer edges thereof, said cover including a plurality of openings which open into at least one of said top and bottom pockets and permit insertion of said side rails into said side pockets and permit insertion of said crossbar into said top pocket seperate from said side rails, said crossbar being insertable into said top pocket solely by inserting said crossbar through one of said openings when said crossbar is separated from said side rails with said corssbar being positioned within said upper pocket for engagement with said side rails, said cover being secured on said back frame wherein said side rails are received vertically in said side pockets and said crossbar extends horizontally within said top pocket and is fixedly engaged with said side rails after insertion of said side rails in said side pockets, said back assembly including a retainer which engages a lower edge of said cover to said mounting bracket to prevent removal of said cover.

10. The chair according to claim 9, wherein said cover is formed of an open mesh material.

11. The chair according to claim 9, wherein said cover is resiliently flexible and is held in tension by engagement of said retainer with said mounting bracket.

12. The chair according to claim 9, wherein said mounting bracket includes a notch arrangement having a forward opening notch, said cover being resiliently stretched to permit sliding of said retainer into engagement with said notch wherein the resiliency of said cover pulls said retaining member rearwardly into said notch.

13. The chair according to claim 9, wherein at least one of said openings is defined on an upper edge of said cover so as to open into said top pocket and said crossbar is inserted through said opening into said top pocket.

14. The chair according to claim 9, wherein said openings are defined on a lower edge of said cover, said side rails being inserted through said openings into said side pockets.

15. The chair according to claim 14, wherein said top, bottom and side pockets define portions of a single open interior of said cover.

16. The chair according to claim 9, wherein said crossbar is provided with alternate shapes, said cover being resilient and conforming to the shape of said crossbar.

17. A chair comprising:

a base; and a seat-back arrangement supported on said base, said seat-back arrangement comprising a seat and a rigid back frame which is supported rearwardly of said seat and comprises a plurality of side rails projecting vertically above said seat in laterally spaced relation, said seat-back arrangement further including a flexible cover adapted to be disposed on said side rails and support a back of a chair occupant, said cover comprising open regions along vertical side edges thereof which open downwardly through bottom open areas and slidably receive said side rails respectively therein such that said cover is slid downwardly onto said side rails, said bottom open areas being laterally spaced apart and separated by a closed central edge section of said cover, said seat-back arrangement further including a retaining member which has an interior section which extends across said central edge section interiorly within said cover and outer end sections which exit said cover through said bottom open areas and engage said back frame to maintain said cover in a vertically taut condition over said back frame.

18. The chair according to claim 17, wherein said cover is resiliently flexible and is held in tension by engagement of said retaining member with said back frame.

19. The chair according to claim 17, wherein said retaining member is a horizontally elongate rod which is inserted into said cover through one of said bottom open areas and spans said central edge section such that the opposite ends of said rod project outwardly of said cover.

20. The chair according to claim 19, wherein said back frame includes a connector bracket having slots corresponding with said opposite end sections of said rod so as to permit pulling of said cover vertically downwardly and then hooking of said opposite end sections of said rod into said slots to maintain said cover in tension.

21. The chair according to claim 17, wherein said back frame includes an upper cross member which extends across and respectively engages upper ends of said side rails, said upper cross member extending along an upper edge of said cover and being slid downwardly with said cover into engagement with said upper rail ends after sliding of said upper rail ends into said bottom open areas of said cover.

22. A chair comprising:

a base; and a seat-back arrangement supported on said base which comprises a seat assembly and a back assembly which is disposed rearwardly of said seat assembly and projects upwardly therefrom, said seat-back assembly comprising a rigid open frame and a flexible cover which fits onto said open frame, said open frame comprising a mounting section and a plurality of side rails projecting lengthwise away from said mounting section in laterally spaced relation from each other, and a crosswise extending crossbar having opposite laterally spaced ends removably engaged with terminal ends of said side rails, said mounting section further comprising a mounting bracket disposed away from said crossbar to define a frame opening crosswise between said side rails and lengthwise between said mounting section and said crossbar, and a flexible cover adapted to fit onto said side rails and overlie said frame opening to support the body of a chair occupant, said cover comprising open side regions which extend lengthwise along opposite side edges of said cover and open lengthwise through open end sections thereof, said side regions being slidable lengthwise onto said terminal ends of said side rails in the absence of said crossbar with said side rails disposed within said open side regions of said cover, said crossbar being supported by a first crosswise edge portion of said cover so as to be fitted onto said terminal ends of said side rails and maintained in engagement with said side rails when said cover is secured in place, said cover including a retaining member at a second crosswise edge portion thereof which engages said open frame to maintain said cover lengthwise in tension after said cover has slidably received said side rails in said open side sections.

23. The chair according to claim 22, wherein said cover includes an open edge section along a top edge thereof in which said crossbar is received in a horizontal orientation, opposite ends of said crossbar being removably engagable respectively with upper portions of said terminal ends of said side rails.

24. The chair according to claim 23, wherein said open edge section is defined by a tubular hem and said cover includes an opening which opens crosswise into said hem section to permit slidable insertion of said crossbar into said hem section, opposite ends of said hem section being in open communication with said open side sections of said cover to permit engagement of said opposite crossbar ends with said terminal ends.

25. The chair according to claim 22, wherein said cover is resiliently flexible and is held in tension by engagement of said retaining member with said open frame.

26. The chair according to claim 25, wherein said open frame includes said mounting bracket to which said retaining member is pulled lengthwise away from said crossbar into locking engagement to maintain said cover lenghtwise in tension.

* * * * *

UNITED STATES PATENT AND TRADEMARK OFFICE

CERTIFICATE OF CORRECTION

PATENT NO. : 7,055,911 B2
APPLICATION NO. : 10/434667
DATED : June 6, 2006
INVENTOR(S) : Stephen J. Simpson et al.

It is certified that error appears in the above-identified patent and that said Letters Patent is hereby corrected as shown below:

Column 9, line 35; change “bottom pocket, a lower” to --bottom pocket which are defined by front and back layers of cover material which forms said cover, a lower--

Column 9, line 38; change “hem section defined therebetween, said cover” to --hem section extending between said lower openings, said central hem section closing off a lower edge of said bottom pocket, and said cover--

Column 9, line 43; change “which is held within said lower pocket” to --which is held interiorly within said bottom pocket--

Column 10, line 11; change “and a cross bar” to --and a separate crossbar--

Column 12, line 12; change “said side” to --said open side--

Signed and Sealed this

Third Day of October, 2006

JON W. DUDAS
*Director of the United States Patent and Trademark Office*